US008256044B1

(12) United States Patent
Park et al.

(10) Patent No.: US 8,256,044 B1
(45) Date of Patent: Sep. 4, 2012

(54) COVERING APPARATUSES FOR PREVENTION OF BED BUG INTRUSION WITH LEG EXTENSION, AND METHODS OF USE THEREOF

(76) Inventors: Jee Sun Park, Duluth, GA (US); Myung Soon Park, Duluth, GA (US); Beck Sun Park, Alpharetta, GA (US)

( * ) Notice: Subject to any disclaimer, the term of this patent is extended or adjusted under 35 U.S.C. 154(b) by 0 days.

(21) Appl. No.: 13/305,798

(22) Filed: Nov. 29, 2011

Related U.S. Application Data

(63) Continuation-in-part of application No. 13/101,342, filed on May 5, 2011, now Pat. No. 8,087,110.

(51) Int. Cl.
*A47C 29/00* (2006.01)

(52) U.S. Cl. ..... 5/414; 5/512; 5/926; 135/96; 135/117

(58) Field of Classification Search ..... 5/1, 97, 5/414, 512, 661, 926; 135/95, 96, 117
See application file for complete search history.

(56) References Cited

U.S. PATENT DOCUMENTS

| | | | | |
|---|---|---|---|---|
| 2,475,515 | A * | 7/1949 | Potter | 135/125 |
| 2,931,373 | A * | 4/1960 | Larson | 135/90 |
| 4,790,340 | A | 12/1988 | Mahoney | |
| 4,852,598 | A | 8/1989 | Griesenbeck | |
| 4,862,534 | A | 9/1989 | Gomez-Marcial | |
| 4,930,251 | A | 6/1990 | Crisanti | |
| 5,134,802 | A | 8/1992 | Cogan et al. | |
| 5,384,925 | A * | 1/1995 | Vail | 5/424 |
| 5,494,066 | A * | 2/1996 | McMahan | 135/87 |
| 6,145,141 | A | 11/2000 | Whittington et al. | |
| 6,550,083 | B1 * | 4/2003 | LaMantia | 5/97 |
| 6,715,168 | B2 * | 4/2004 | Williams | 5/414 |
| 7,793,920 | B2 | 9/2010 | Bauer et al. | |
| 7,921,863 | B2 * | 4/2011 | Ways | 135/125 |
| 8,087,110 | B1 | 1/2012 | Park et al. | |
| 2008/0072944 | A1 | 3/2008 | Wu | |
| 2010/0065094 | A1 | 3/2010 | Ways | |
| 2010/0132752 | A1 | 6/2010 | Vestergaard Frandsen | |
| 2010/0186792 | A1 | 7/2010 | Imhof | |
| 2011/0203158 | A1 * | 8/2011 | Messian | 43/114 |

* cited by examiner

*Primary Examiner* — Michael Trettel
(74) *Attorney, Agent, or Firm* — Thomas R. Williamson, III; Benjamin A. Balser; Balser & Grell IP Law

(57) ABSTRACT

A bed covering apparatus that prevents bed bugs from intrusion to an enclosed sleeping area, wherein the bed covering apparatus has a net for exclusion of insects and an openable section disposed at one end of the net that is dimensioned to accommodate legs of a person sleeping within the net, and also contains at least one slippery section to which bed bugs cannot adhere, thereby causing the bed bugs to fall from the netted sleeping area before they have an opportunity to enter the sleeping enclosure. The bed covering apparatus further may comprise straps to securely attach it to a mattress.

21 Claims, 7 Drawing Sheets

COVERING APPARATUSES FOR PREVENTION OF BED BUG INTRUSION WITH LEG EXTENSION, AND METHODS OF USE THEREOF

CROSS-REFERENCE TO RELATED APPLICATIONS

The present application is a continuation-in-part application of Ser. No. 13/101,342, entitled "Covering Apparatuses for Prevention of Bed Bug Intrusion and Methods of Use Thereof", filed May 5, 2011, which has issued as U.S. Pat. No. 8,087,110, and claims priority thereto and the full benefit thereof.

FEDERALLY SPONSORED RESEARCH OR DEVELOPMENT

None

PARTIES TO A JOINT RESEARCH AGREEMENT

None

REFERENCE TO A SEQUENCE LISTING

None

BACKGROUND OF THE INVENTION

1. Technical Field of the Invention

The present invention relates generally to protective covering devices to prevent intrusion of bed bugs into sleeping areas, and more specifically to a net for covering a sleeping area having an extension that can be opened to accommodate the legs of the sleeper, wherein the covering net further has slippery panels therein to prevent bed bugs from climbing up or down to the sleeping area.

2. Description of Related Art

Bed bugs and other parasites have affected and attacked humans for centuries. The adverse health effects and the general discomfort caused by such parasites has been a constant issue. Unfortunately, despite our best efforts, such parasites continue to defy many of our defenses against them.

Generally, the best method of prevention of an attack by such insects is to prevent their intrusion into a sleeping area. Mesh-type devices have typically been utilized to exclude many insects, and, occasionally, an adhesive area is utilized to trap an insect before it reaches the sleeping area.

One prior device teaches a bed tent, with net portion, having a rectangular base tailored to fit around a bed mattress, a zippered door, and a canopy portion supported by the base portion in an upright position over the mattress. However, this device lacks the ability to accommodate the legs of a tall person and further lacks a means for excluding crawling insects such as bed bugs.

Another previous device teaches a mosquito net for use with a hammock comprising a bottom rectangular sheet and a horizontal triangular prism shaped net. Again, this device lacks the ability to accommodate the legs of a tall person and further lacks a means for excluding crawling insects such as bed bugs.

Still another device teaches a self-supporting insect net enclosure with tie ribbon loops attached thereto for suspending the netting fabric above the floor. Again, as with the previous devices, this device lacks the ability to accommodate the legs of a tall person and further lacks a means for excluding crawling insects such as bed bugs.

A further device teaches an insect trap having an enclosed housing with one open side and adhesive inside to trap and retain insects. Insects enter the housing through the open side and are contained by the adhesive material. Insects trying to escape encounter a slippery coating applied to the inside of the device that prevents them from escaping. Unfortunately, this device does the exact opposite from what is desired by attracting and containing insects, but does not provide the ability to exclude insects from entering the enclosed area.

Therefore, it is readily apparent that there is a need for a covering apparatus for prevention of bed bug intrusion into a sleeping area that has an openable extension for accommodating the legs of a sleeping person.

BRIEF SUMMARY OF THE INVENTION

Briefly described, in a preferred embodiment, the present invention overcomes the above-mentioned disadvantages and meets the recognized need for such a device by providing a bed covering apparatus that prevents bed bugs from intrusion to an enclosed sleeping area and which has an openable section that accommodates the legs of the sleeping person when such person's body is longer than the sleeping area. The bed covering apparatus has a net for exclusion of a variety of insects, including bed bugs, and also contains at least one slippery section to which bed bugs cannot adhere, thereby causing the bed bugs to fall from the netted sleeping area before they have an opportunity to enter the sleeping enclosure.

According to its major aspects and broadly stated, the present invention in its preferred form is a covering apparatus for prevention of bed bug intrusion to a sleeping area by enclosing the sleeping area, wherein a preferred embodiment comprises a net with a top, a bottom and a plurality of sides, along with an openable extension to accommodate the legs of a person sleeping in the apparatus and also an exclusory zone comprising a material to which bed bugs cannot cling disposed on an exterior portion of the net. The exclusory zone comprises one or more peripheral bands of smooth, slick material that is slippery to bed bugs encountering same, and from which bed bugs will fall once they encounter same. The peripheral bands are continuous and are disposed around, selectively, top and bottom portions of the sides. The bottom peripheral band comprises a flap that extends below the bottom of the net and which forms a portion of a door opening in the net to allow access to the interior sleeping area.

The covering apparatus may also selectively include an adhesive zone that is continuous and which extends peripherally around the sides. The adhesive zone is selectively disposed either below the lower peripheral band or above the lower peripheral band, or in both locations.

In a preferred embodiment, the bed bug exclusion apparatus comprises a net having four sides, a top and a bottom, an openable extension to accommodate the legs of a person sleeping in the apparatus, and also a first peripheral band of smooth, slick material to which bed bugs cannot cling extending around the sides and disposed proximate the top, and a second peripheral band of smooth, slick material to which bed bugs cannot cling, extending around the sides and disposed proximate the bottom.

The preferred embodiment further includes a method of preventing bed bug intrusion into the sleeping area, and, if present, from the door section of the net, by covering the sleeping area with the net, wherein the net encloses the sleeping area, thereby preventing bed bug incursion into the sleeping area via the exclusory zones.

More specifically, the present invention is a covering apparatus having an interior, a top with a periphery, a bottom, a front side, a rear side, a right side, a left side, support loops and an openable extension to accommodate the legs of a person sleeping in the apparatus. The support loops are utilized to secure the covering apparatus to hang same from an overhead support. The covering apparatus further comprises netting dimensioned to exclude insects that permits airflow through the covering apparatus.

The front side has a door therein that has a center panel, a right panel and a left panel. The center panel is opened via operation of a zipper, by pulling the zipper tag, and opening the center panel to permit access to the interior of the covering apparatus.

An openable section is disposed at one end of the apparatus, wherein the openable section is secured via a zipper or similar closure member. Once the zipper is released, the openable section expands to accommodate the legs of a sleeping person.

The covering apparatus further comprises exclusory zones. An upper exclusory zone is disposed on the sides proximate the top, and runs continuously peripherally around the sides. A lower exclusory zone is disposed on the sides proximate the bottom, running continuously and peripherally around the sides. The lower exclusory zone and upper exclusory zone each comprise a width that is dimensioned to greatly exceed the length of a bed bug in order that any bed bugs that encounter the exclusory zones will be unable to grip the covering apparatus before falling off. The exclusory zones are smooth and/or slick to prevent bed bugs from crawling thereon, and are disposed vertically to cause bed bugs to fall therefrom. The lower exclusory zone may selectively dip below the top of a mattress upon which the covering apparatus is disposed, thereby providing an overlapping section or flap, wherein the flap section is a continuous portion of the exclusory zone that is disposed below the bottom extending downward over the front of the mattress.

The covering apparatus may selectively include one or more adhesive strips, wherein the adhesive strip runs continuously and peripherally around the bottom, preferably below the lower exclusory zone. Alternatively, the adhesive strip may be disposed above the lower exclusory zone. Moreover, adhesive strips could alternatively be disposed both below and above lower exclusory zone. Thus, bed bugs crawling up the mattress will encounter the lower exclusory zone, lose their grip and fall therefrom, off of the covering apparatus. Further, via addition of adhesive strips, most bed bugs are trapped on the adhesive strip below the lower exclusory zone and only bed bugs that have succeeded in traversing the adhesive strip reach the lower exclusory zone, thereby being precipitated from the covering apparatus after sliding off of the lower exclusory zone. Moreover, any bed bugs that might possibly succeed in traversing the exclusory zone are trapped by the adhesive strip when same is provided above the exclusory zone. Finally, the adhesive strips provide visual evidence of bed bug infestation by retaining the bed bugs thereon.

An alternative embodiment comprises a self-supporting covering apparatus having a top, a bottom, a front side, a rear side, a right side, a left side and may further include an openable section to accommodate the legs of a person sleeping inside the apparatus. The self-supporting covering apparatus may be internally supported by poles or a frame, such as, for exemplary purposes only, a frame of bent support rods as is known in the art. The self-supporting covering apparatus further comprises netting and an exclusory zone as described in detail hereinabove, wherein the exclusory zone is disposed peripherally around the bottom, and wherein the exclusory zone comprises a flap section that is a continuous portion of the exclusory zone that is disposed below the bottom extending downward over the front of the mattress. The front side further comprises a zipper and a zipper tag to facilitate opening of the front side.

Another alternate embodiment comprises a pole-supported covering apparatus having a top periphery, a bottom, a front side with a zipper, a rear side, a right side, a left side and an openable section at one end of the apparatus, wherein the openable section is secured via a closure mechanism, such as, for exemplary purposes only, a zipper, and wherein when opened, the openable section accommodates the legs of a sleeping person. The pole-supported covering apparatus is internally supported by a central pole or poles as is known in the art. The pole-supported covering apparatus further comprises netting and exclusory zones as described in detail hereinabove disposed on the sides, proximate the top and bottom, running continuously and peripherally around the sides.

The lower exclusory zone may selectively dip below the top of the mattress providing an overlapping section or flap, wherein the flap section is a continuous portion of the exclusory zone that is disposed below the bottom of the covering apparatus, extending downward over the front of the mattress. The exclusory zones are smooth and/or slick to prevent bed bugs from crawling thereon, and are vertically disposed to cause bed bugs to fall therefrom.

Accordingly, a feature and advantage of the present invention is its ability to prevent access of bed bugs to sleeping enclosures.

Another feature and advantage of the present invention is its ability to prevent bed bugs from crawling down to a sleeping surface.

Still another feature and advantage of the present invention is its ability to prevent bed bugs from crawling up to a sleeping surface.

Yet another feature and advantage of the present invention is its ability to prevent bed bugs from gripping onto a sleep area cover.

Yet still another feature and advantage of the present invention is that it can, selectively, adhesively trap bed bugs in order to verify their presence or absence.

Still yet another feature and advantage of the present invention is that it can accommodate the legs of a sleeping person when such legs extend longer than the internal area of the covering apparatus.

These and other features and advantages of the present invention will become more apparent to one skilled in the art from the following description and claims when read in light of the accompanying drawings.

BRIEF DESCRIPTION OF THE SEVERAL VIEWS OF THE DRAWINGS

The present invention will be better understood by reading the Detailed Description of the Preferred and Selected Alternate Embodiments with reference to the accompanying drawing figures, in which like reference numerals denote similar structure and refer to like elements throughout, and in which.

DETAILED DESCRIPTION OF THE PREFERRED AND SELECTED ALTERNATE EMBODIMENTS OF THE INVENTION

In describing the preferred and selected alternate embodiments of the present invention, as illustrated in FIGS. 1-7C, specific terminology is employed for the sake of clarity. The invention, however, is not intended to be limited to the specific terminology so selected, and it is to be understood that each specific element includes all technical equivalents that operate in a similar manner to accomplish similar functions.

Figure 1:
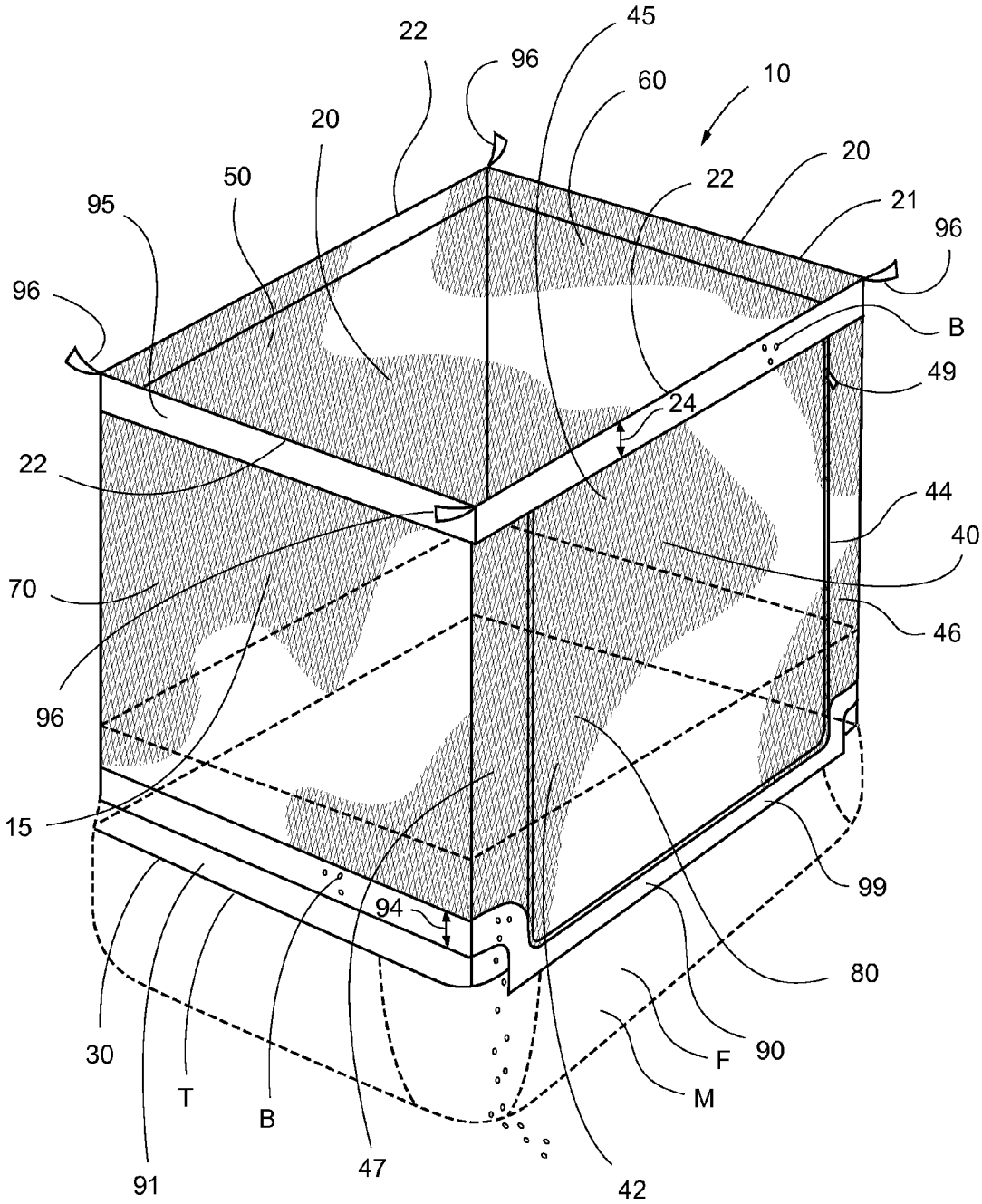
FIG. 1 is a perspective view of a covering apparatus for prevention of bed bug intrusion according to an alternate embodiment, having two exclusory zones and shown installed on a mattress.

Referring now to FIG. 1, the present invention in an alternate embodiment is covering apparatus 10, wherein covering apparatus 10 comprises interior 15, top 20 having top periphery 21, and bottom 30, front side 40, rear side 50, right side 60, left side 70 and support loops 96, wherein support loops 96 are utilized to secure covering apparatus 10 to hang same from an overhead support (not shown), and wherein front side 40, rear side 50, right side 60 and left side 70 comprise top edges 22. It will be recognized by those skilled in the art that other support mounts or other means of support than support loops 96 could be utilized without departing from the spirit of the alternate embodiment. Covering apparatus 10 further comprises netting 80, wherein netting 80 permits airflow therethrough, while being dimensioned to exclude insects, such as flying insects and bed bugs B.

Front side 40 comprises door 42, wherein door 42 comprises center panel 45, right panel 46 and left panel 47. Center panel 45 is openable via operation of zipper 44, by pulling zipper tag 49, wherein opening of center panel 45 permits access to interior 15 of covering apparatus 10.

Covering apparatus 10 further comprises exclusory zones 90, 95, wherein upper exclusory zone 95 is disposed on sides 40, 50, 60, 70 proximate top 20 and top periphery 21, wherein upper exclusory zone 95 runs continuously and peripherally around sides 40, 50, 60, 70 at top edges 22, and wherein lower exclusory zone 90 is disposed on sides 40, 50, 60, 70 proximate bottom 30, running continuously and peripherally around sides 40, 50, 60, 70. Lower exclusory zone 90 comprises width 94 and upper exclusory zone 95 comprises width 24, wherein widths 24, 94 are dimensioned to greatly exceed the length of bed bugs B, in order that bed bugs B will be unable to grip any portion of covering apparatus 10 before falling off. Lower exclusory zone 90 may selectively dip below top T of mattress M, providing overlapping section or flap 99. Exclusory zones 90, 95 are smooth and/or slick to prevent bed bugs B from crawling thereon, wherein the vertical disposition of exclusory zones 90, 95 causes bed bugs B to fall therefrom.

Covering apparatus 10 selectively may include adhesive strip 91, wherein adhesive strip 91 runs continuously and peripherally around bottom 30, below lower exclusory zone 90. In an alternative embodiment, adhesive strip 91 may be disposed above lower exclusory zone 90. Moreover, adhesive strips 91 could alternatively be disposed both below and above lower exclusory zone 90.

In use, covering apparatus 10 is disposed over a sleeping area, such as, for exemplary purposes only, mattress M and is supported by securing a supporting device (not shown) to covering apparatus 10 via attachment of support loops 96. Bottom 30 is disposed around top T of mattress M forming an enclosure comprising covering apparatus 10 having top 20 and four sides 40, 50, 60, 70 and mattress M on the bottom. A person enters interior 15 via door 42, securing door 42 closed via zipper 44. Bed bugs B crawling from above covering apparatus 10 will encounter upper exclusory zone 95, lose their grip and fall off of covering apparatus 10. Additionally, bed bugs B crawling up mattress M, will encounter lower exclusory zone 90, lose their grip and fall therefrom, off of covering apparatus 10. Further, via addition of adhesive strips 91, most bed bugs B are trapped on adhesive strip 91 below lower exclusory zone 90 and only bed bugs B that have succeeded in traversing adhesive strip 91 reach lower exclusory zone 90, thereby being precipitated from covering apparatus 10 after sliding off of lower exclusory zone 90. Moreover, any bed bugs B that might possibly succeed in traversing exclusory zone 90 are trapped by adhesive strip 91 when same is provided above exclusory zone 90. Finally, adhesive strips 91 provide visual evidence of bed bug infestation by retaining bed bugs B thereon.

Figure 2:
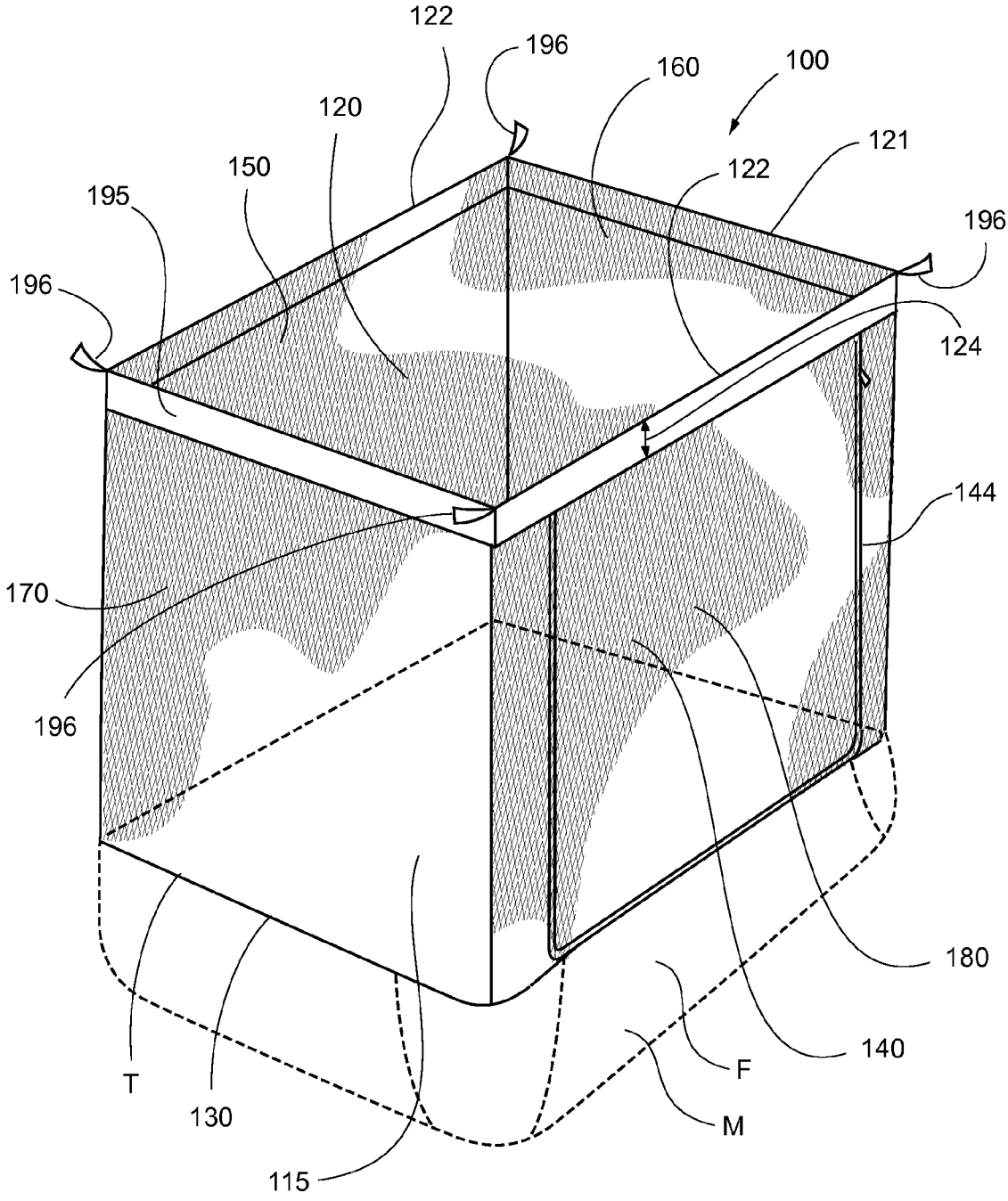
FIG. 2 is a perspective view of a covering apparatus for prevention of bed bug intrusion according to an alternate embodiment, having a top exclusory zone and shown installed on a mattress.

Referring now more specifically to FIG. 2, illustrated therein is an alternate embodiment of device 10, wherein the alternate embodiment of FIG. 2 is substantially equivalent in form and function to that of the alternate embodiment detailed and illustrated in FIG. 1 except as hereinafter specifically referenced. Specifically, the embodiment of FIG. 2 comprises covering apparatus 100, wherein covering apparatus 100 comprises interior 115, top 120 having top periphery 121, bottom 130, front side 140 openable via zipper 144, rear side 150, right side 160, left side 170 and support loops 196, wherein support loops 196 are utilized to secure covering apparatus 100 to hang same from an overhead support (not shown), and wherein front side 140, rear side 150, right side 160 and left side 170 comprise top edges 122. Covering apparatus 100 further comprises netting 180, wherein netting 180 permits airflow therethrough, while being dimensioned to exclude insects, such as flying insects and bed bugs B.

Covering apparatus 100 further comprises exclusory zone 195, wherein exclusory zone 195 is disposed on sides 140, 150, 160, 170 proximate top 120, running continuously and peripherally around top edges 122 of sides 140, 150, 160, 170. Exclusory zone 195 comprises width 124, wherein width 124 is dimensioned to greatly exceed the length of bed bugs B, in order that bed bugs B will be unable to grip any portion of covering apparatus 100 before falling off. Exclusory zone 195 is smooth and/or slick to prevent bed bugs B from crawling thereon, wherein the vertical disposition of exclusory zone 195 causes bed bugs B to fall therefrom.

Figure 3:
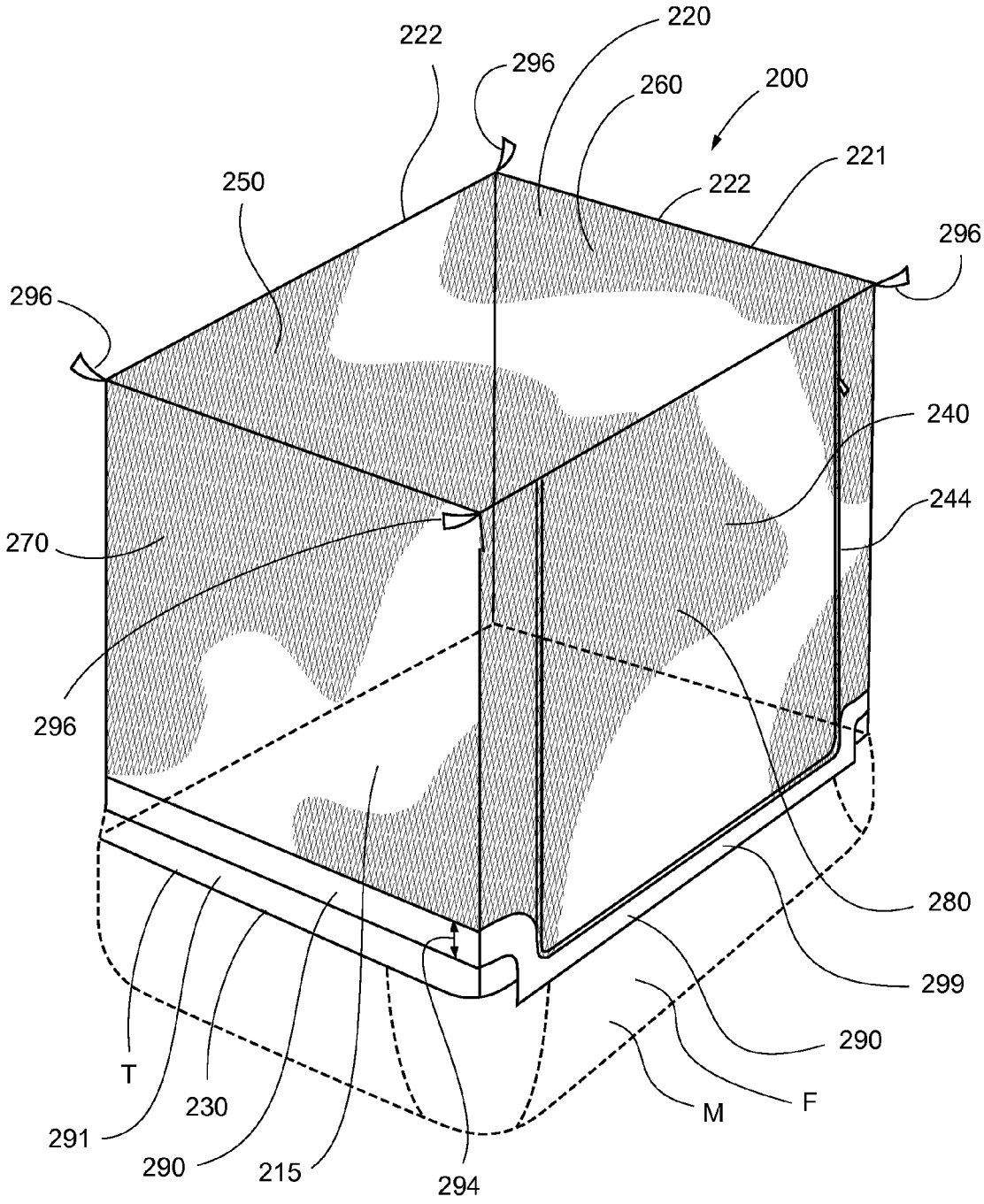
FIG. 3 is a perspective view of a covering apparatus for prevention of bed bug intrusion according to an alternate embodiment, having a bottom exclusory zone and shown installed on a mattress.

Referring now more specifically to FIG. 3, illustrated therein is an alternate embodiment of device 10, wherein the alternate embodiment of FIG. 3 is substantially equivalent in form and function to that of the alternate embodiment detailed and illustrated in FIG. 1 except as hereinafter specifically referenced. Specifically, the embodiment of FIG. 3 comprises covering apparatus 200, wherein covering apparatus 200 comprises interior 215, top 220 having top periphery 221, and bottom 230, front side 240 openable via zipper 244, rear side 250, right side 260, left side 270 and support loops 296, wherein support loops 296 are utilized to secure covering apparatus 200 to hang same from an overhead support (not shown), and wherein front side 240, rear side 250, right side 260 and left side 270 comprise top edges 222. Covering apparatus 200 further comprises netting 280, wherein netting 280 permits airflow therethrough, while being dimensioned to exclude insects, such as flying insects and bed bugs B.

Covering apparatus 200 further comprises exclusory zone 290, wherein exclusory zone 290 is disposed on sides 240, 250, 260, 270 proximate bottom 230, running continuously and peripherally around sides 240, 250, 260, 270, and wherein exclusory zone 290 comprises flap section 299, wherein flap section 299 is a continuous portion of exclusory zone 290 that is disposed below bottom 230 extending downward over front F of mattress M.

Exclusory zone 290 comprises width 294, wherein width 294 is dimensioned to greatly exceed the length of bed bugs B, in order that bed bugs B will be unable to grip any portion of covering apparatus 200 before falling off. Exclusory zone 290 is smooth and/or slick to prevent bed bugs B from crawling thereon, wherein the vertical disposition of exclusory zone 290 causes bed bugs B to fall therefrom.

Covering apparatus 200 selectively may include adhesive strip 291, wherein adhesive strip 291 runs continuously and peripherally around bottom 230 below exclusory zone 290. In another alternative embodiment, adhesive strip 291 may be disposed above exclusory zone 290. Moreover, adhesive strips 291 could alternatively be disposed both below and above exclusory zone 290.

Figure 4A:
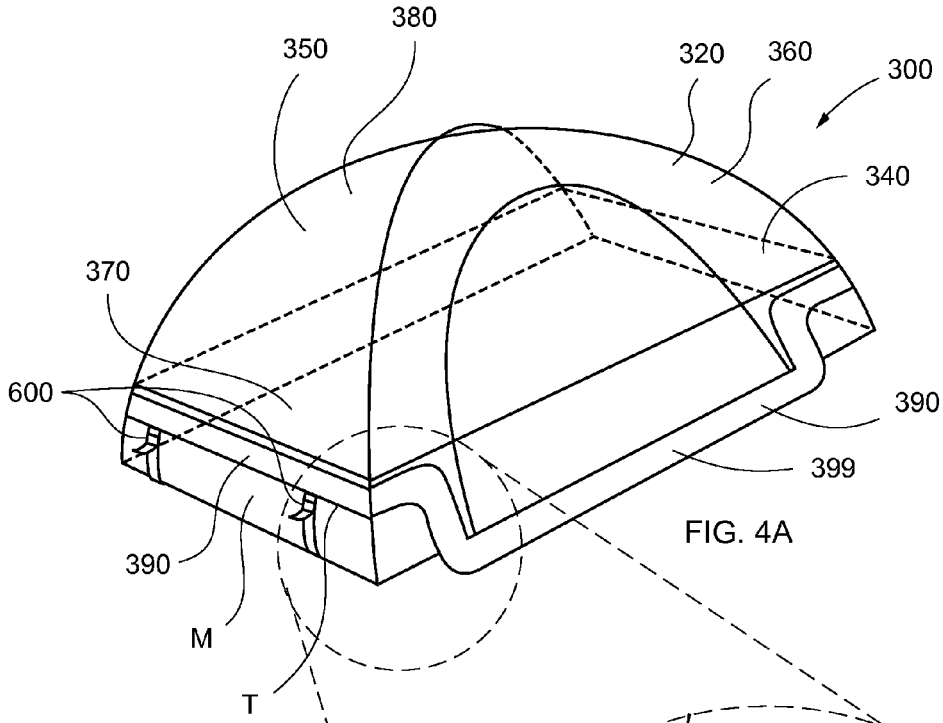
FIG. 4A is a perspective view of a covering apparatus for prevention of bed bug intrusion according to an alternate embodiment, having a bottom exclusory zone and shown installed on a mattress.
Figure 4B:
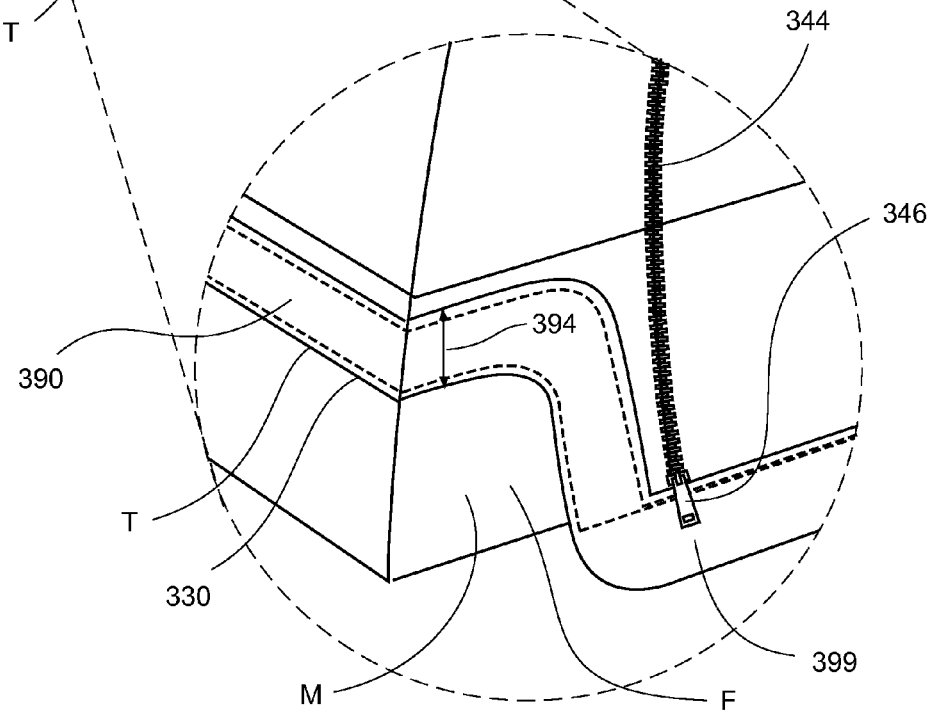
FIG. 4B is a detail perspective view of the door flap and closure portion of FIG. 4A.

Referring now more specifically to FIGS. 4A-4B, illustrated therein is an alternate embodiment of device 10, wherein the alternate embodiment of FIGS. 4A-4B is substantially equivalent in form and function to that of the alternate embodiment detailed and illustrated in FIGS. 1-3 except as hereinafter specifically referenced. Specifically, the embodiment of FIGS. 4A-4B comprises self-supporting covering apparatus 300, wherein self-supporting covering apparatus 300 comprises top 320, bottom 330, front side 340, rear side 350, right side 360 and left side 370. Self-supporting covering apparatus 300 may be internally supported by poles or a frame, such as, for exemplary purposes only, a frame of bent support rods as is known in the art, without departing from the spirit of this alternative embodiment. Self-supporting covering apparatus 300 further comprises netting 380 and exclusory zone 390, wherein exclusory zone 390 is disposed peripherally around bottom 330, and wherein exclusory zone 390 comprises flap section 399, wherein flap section 399 is a continuous portion of exclusory zone 390 that is disposed below bottom 330 extending downward over front F of mattress M. Front side 340 further comprises zipper 344 and zipper tag 346 to facilitate opening of front side 340.

Exclusory zone 390 comprises width 394, wherein width 394 is dimensioned to greatly exceed the length of bed bugs B, in order that bed bugs B will be unable to grip any portion of covering apparatus 300 before falling off. Exclusory zone 390 is smooth and/or slick to prevent bed bugs B from crawling thereon, wherein the vertical disposition of exclusory zone 390 causes bed bugs B to fall therefrom.

Additionally, self-supporting covering apparatus 300 could comprise one or more straps 600, wherein straps 600 loop around mattress M to securely hold self-supporting covering apparatus 300 in place on mattress M. Straps 600 comprise a synthetic leather-like material which to securely retain self-supporting covering apparatus 300 against mattress M, such as, for exemplary purposes only, by the surface roughness of straps 600.

Figure 5:
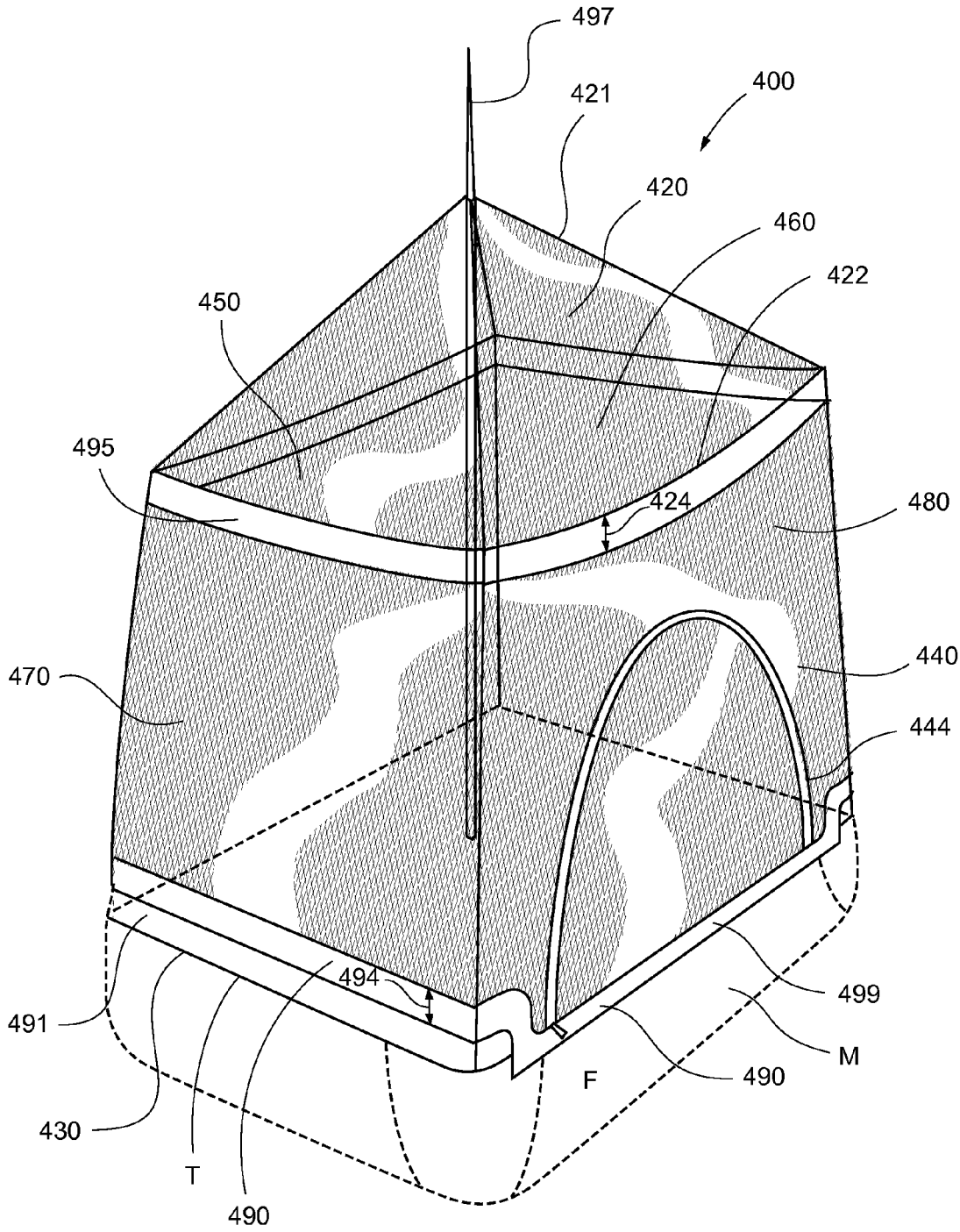
FIG. 5 is a perspective view of a covering apparatus for prevention of bed bug intrusion according to an alternate embodiment, having top and bottom exclusory zones and shown installed on a mattress with a central pole support.
Figure 6A:
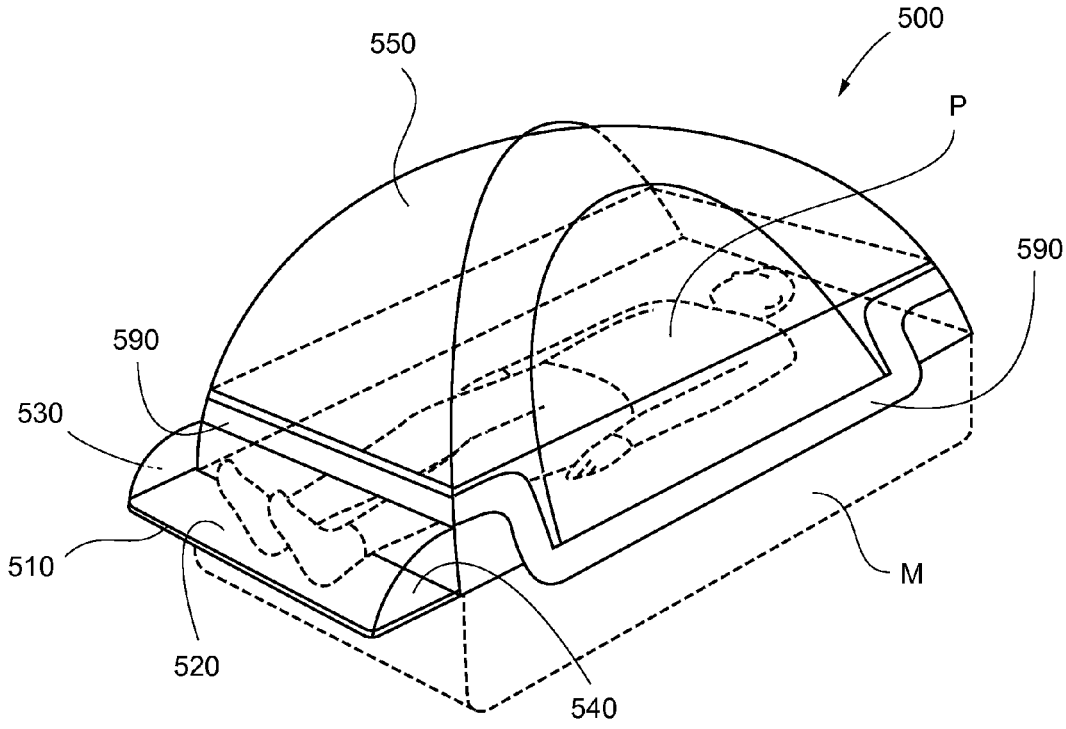
FIG. 6A is a perspective view of a covering apparatus for prevention of bed bug intrusion according to a preferred embodiment having an openable leg extension.
Figure 6B:
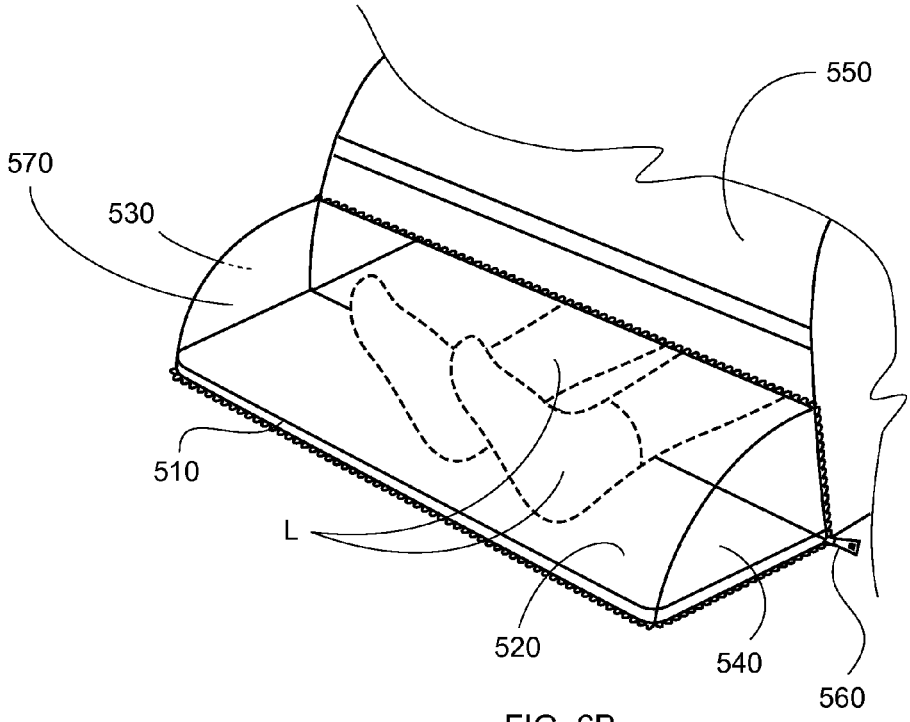
FIG. 6B is a perspective view of the leg extension of the covering apparatus of FIG. 6A according to a preferred embodiment, shown open and in use.

Referring now more specifically to FIG. 5, illustrated therein is an alternate embodiment of device 10, wherein the alternate embodiment of FIG. 5 is substantially equivalent in form and function to that of the alternate embodiments detailed and illustrated in FIGS. 1-3 except as hereinafter specifically referenced. Specifically, the embodiment of FIG. 5 comprises pole-supported covering apparatus 400, wherein pole-supported covering apparatus 400 comprises top 420 having top periphery 421, bottom 430, front side 440 with zipper 444, rear side 450, right side 460 and left side 470, and wherein front side 440, rear side 450, right side 460 and left side 470 comprise top edges 422. Pole-supported covering apparatus 400 is internally supported by central pole 497 or poles as is known in the art, without departing from the spirit of this alternative embodiment. Pole-supported covering apparatus 400 further comprises netting 480 and exclusory zones 490, 495, wherein upper exclusory zone 495 is disposed on sides 440, 450, 460, 470 proximate top 420, running continuously and peripherally around top periphery 422 of sides 440, 450, 460, 470, and wherein lower exclusory zone 490 is disposed on sides 440, 450, 460, 470 proximate bottom 430, running continuously and peripherally around sides 440, 450, 460, 470. Lower exclusory zone 490 comprises width 494 and upper exclusory zone 495 comprises width 424, wherein widths 424, 494 are dimensioned to greatly exceed the length of bed bugs B, in order that once bed bugs B encounter exclusory zones 490, 495, bed bugs B will be unable to grip covering apparatus 400 before falling off. Lower exclusory zone 490 may selectively dip below top T of mattress M, providing overlapping section or flap 499, wherein flap section 499 is a continuous portion of exclusory zone 490 that is disposed below bottom 430 extending downward over front F of mattress M. Exclusory zones 490, 495 are smooth and/or slick to prevent bed bugs B from crawling thereon, wherein the vertical disposition of exclusory zones 490, 495 causes bed bugs B to fall therefrom.

Covering apparatus 400 selectively may include adhesive strip 491, wherein adhesive strip 491 runs continuously and peripherally around bottom 430 below lower exclusory zone 490. In another alternative embodiment, adhesive strip 491 may be disposed above lower exclusory zone 490. Moreover, adhesive strips 491 could alternatively be disposed both below and above lower exclusory zone 490.

In a preferred embodiment as depicted in FIGS. 6A-7C, covering apparatus 500 is substantially equivalent in form and function to that of the alternate embodiment detailed and illustrated in FIGS. 4A and 4B, except as hereinafter specifically referenced. Covering apparatus 500 is preferably disposed on mattress M, or alternatively may be disposed on a ground surface. Covering apparatus 500 comprises end 505 and top 550, wherein top 550 has exclusory zone 590 thereon.

Disposed at end 505 is extension 510, wherein extension 510 comprises base 520, first side 530, second side 540, closing fastener 580 and cover 570. Closing fastener 580 comprises any suitable fastener for removably securing extension 510 to end 505 when extension 510 is folded proximate end 505. Closing fastener 580 preferably comprises zipper 580 having cooperating halves 580A, 580B, and zipper tag 560 to facilitate in pulling zipper 580 closed or open. Zipper 580 comprises first edge 582, second edge 584 and third edge 586. First edge 582 is disposed on, and extends along, first side 530, second edge 584 is disposed on, and extends along, end 505, and third edge 586 is disposed on, and extends along, second side 540. Zipper 580 could alternatively extend only along end 505, and first side 530 and second side 540 could be unsecured, wherein zipper 580 comprises a separable zipper as is known in the art, thereby permitting opening of extension 510 by simply unzipping along end 505.

Figure 7A:
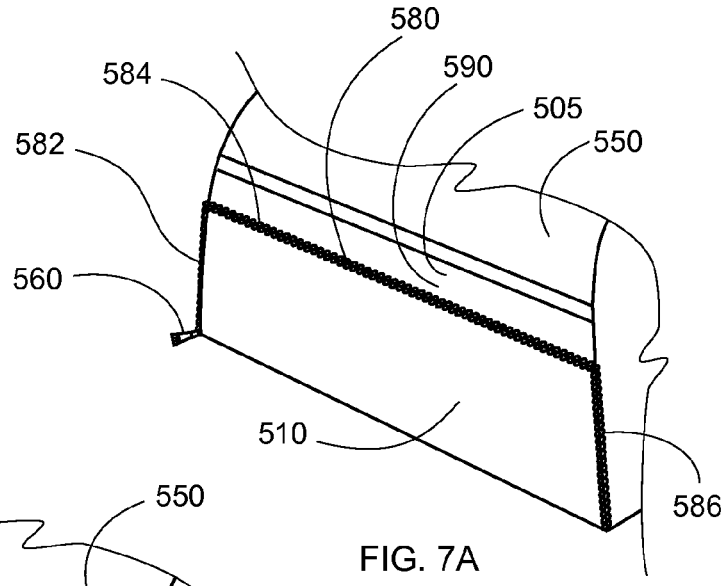
FIG. 7A is a perspective view of the leg extension of the covering apparatus of FIG. 6A according to a preferred embodiment, shown closed.
Figure 7B:
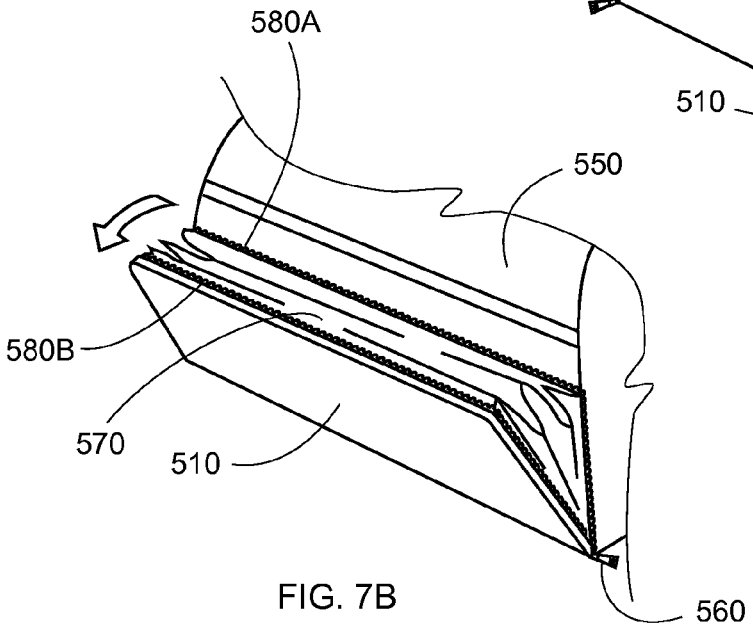
FIG. 7B is a perspective view of the leg extension of the covering apparatus of FIG. 6A according to a preferred embodiment, shown partially opened.
Figure 7C:
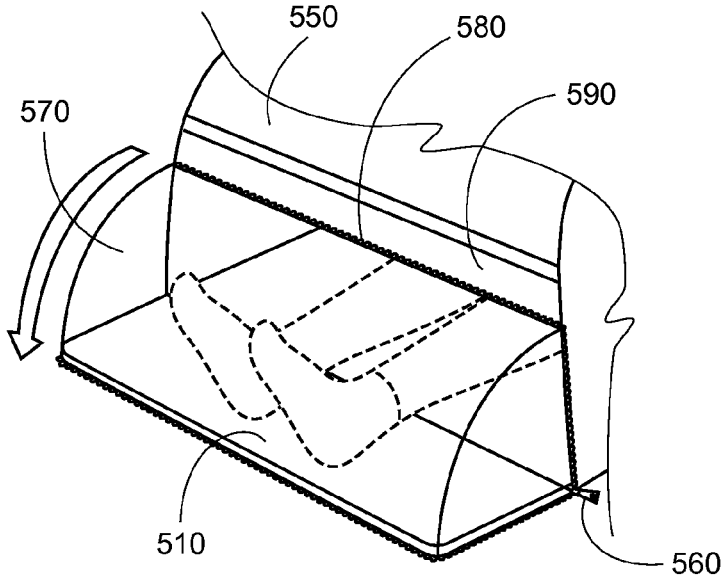
FIG. 7C is a perspective view of the leg extension of the covering apparatus of FIG. 6A according to a preferred embodiment, shown fully opened.

In use, after setting up covering apparatus 500 on mattress M, person P unzips zipper 580 permitting extension 510 to be opened downward (best shown in FIGS. 7B and 7C). Person P then enters covering apparatus 500 and inserts legs L into extension 510. Cover 570, base 520, first side 530 and second side 540 fully enclose lower portion of legs L and prevent intrusion by bed bugs into covering apparatus 500. When finished sleeping, person P folds extension 510 back up to end 505, folding the material of cover 570 inwardly, and subsequently secures extension 510 via zipper 580.

The foregoing description and drawings comprise illustrative embodiments of the present invention. Having thus described exemplary embodiments of the present invention, it should be noted by those skilled in the art that the within disclosures are exemplary only, and that various other alternatives, adaptations, and modifications may be made within the scope of the present invention. Merely listing or numbering the steps of a method in a certain order does not constitute any limitation on the order of the steps of that method. Many modifications and other embodiments of the invention will come to mind to one skilled in the art to which this invention pertains having the benefit of the teachings presented in the foregoing descriptions and the associated drawings. Although specific terms may be employed herein, they are used in a generic and descriptive sense only and not for purposes of limitation. Accordingly, the present invention is not limited to the specific embodiments illustrated herein, but is limited only by the following claims.

What is claimed is:

1. A covering apparatus for prevention of bed bug intrusion to a sleeping area, said apparatus comprising:

a net having a top and a plurality of sides, wherein said net encloses the sleeping area; and an openable section disposed at one end of said net, wherein said openable section is dimensioned to accommodate legs of a person sleeping within said net, and wherein said openable section comprises a base, a first side, a second side and a cover, and wherein said cover, said base, said first side and said second side fully enclose a lower portion of the legs.

2. The covering apparatus of claim 1, further comprising an exclusory zone disposed on an exterior portion of said net, wherein said exclusory zone comprises a material to which bed bugs cannot cling.

3. The covering apparatus of claim 2, wherein said exclusory zone comprises at least one peripheral band of slick material.

4. The covering apparatus of claim 3, wherein said at least one peripheral band is continuous and is disposed around a top portion of said plurality of sides of said net.

5. The covering apparatus of claim 4, wherein said at least one peripheral band is continuous and is disposed around a bottom portion of said plurality of sides of said net.

6. The covering apparatus of claim 5, wherein said at least one peripheral band comprises a flap, and wherein said flap extends below a bottom of said covering apparatus.

7. The covering apparatus of claim 6, wherein said net comprises a door, and wherein said flap comprises a portion of said door.

8. The covering apparatus of claim 7, wherein said at least one peripheral band comprises two peripheral bands.

9. The covering apparatus of claim 3, further comprising an adhesive zone.

10. The covering apparatus of claim 9, wherein said adhesive zone is continuous and extends peripherally around said plurality of sides.

11. The covering apparatus of claim 10, wherein said adhesive zone is disposed below said at least one peripheral band.

12. The covering apparatus of claim 10, wherein said adhesive zone is disposed above said at least one peripheral band.

13. A method of preventing bed bug intrusion into a sleeping area, said method comprising the steps of:

covering a sleeping area with a net having a top and a plurality of sides, an openable section disposed at one end of said net and an exclusory zone disposed on an exterior portion of said net, wherein said openable section is dimensioned to accommodate legs of a person sleeping within said net, and wherein said openable section comprises a base, a first side, a second side and a cover, and wherein said cover, said base, said first side and said second side fully enclose a lower portion of the legs, and wherein said net encloses the sleeping area, and wherein said exclusory zone comprises a material to which bed bugs cannot cling; and preventing bed bug incursion into the sleeping area via said net and said exclusory zone.

14. The method of claim 13, wherein said step of preventing further comprises:

excluding bed bugs from the sleeping area via said exclusory zone, wherein said exclusory zone comprises a peripheral band of slick material.

15. The method of claim 13, wherein said step of preventing further comprises:

excluding bed bugs from the sleeping area via said exclusory zone, wherein said exclusory zone comprises two peripheral bands of slick material, and wherein one of said peripheral bands is disposed on said plurality of sides proximate said top of said net and wherein another of said peripheral bands is disposed on said plurality of sides proximate a bottom of said net.

16. The method of claim 13, said method further comprises excluding bed bugs from a door section of said net.

17. A bed bug exclusion apparatus comprising:

a net having four sides, a top, a bottom, and an openable section disposed at one end of said net, wherein said openable section is dimensioned to accommodate legs of a person sleeping within said net, and wherein said openable section comprises a base, a first side, a second side and a cover, and wherein said cover, said base, said first side and said second side fully enclose a lower portion of the legs;

a first peripheral band of smooth, slick material to which bed bugs cannot cling, said first peripheral band extending around said sides and disposed proximate said top; and a second peripheral band of smooth, slick material to which bed bugs cannot cling, said second peripheral band extending around said sides and disposed proximate said bottom.

18. The bed bug exclusion apparatus of claim 17, further comprising a peripheral adhesive strip.

19. The bed bug exclusion apparatus of claim 18, wherein said peripheral adhesive strip is disposed below said second peripheral band.

20. The bed bug exclusion apparatus of claim 18, wherein said peripheral adhesive strip is disposed above said second peripheral band.

21. The bed bug exclusion apparatus of claim 17, further comprising at least one strap adapted to secure said bed bug exclusion apparatus to a mattress.

* * * * *